US006443598B1

(12) United States Patent
Morgan

(10) Patent No.: US 6,443,598 B1
(45) Date of Patent: Sep. 3, 2002

(54) LIGHTING APPLIANCE WITH GLARE REDUCING CROSS BLADES

(75) Inventor: Brian Morgan, Lymington (GB)

(73) Assignee: Luxonic Lighting PLC (GB)

( * ) Notice: Subject to any disclaimer, the term of this patent is extended or adjusted under 35 U.S.C. 154(b) by 0 days.

(21) Appl. No.: 09/550,323

(22) Filed: Apr. 14, 2000

(30) Foreign Application Priority Data

Apr. 17, 1999 (GB) ..... 9908728

(51) Int. Cl.[7] ..... F21V 7/04

(52) U.S. Cl. ..... 362/342; 362/224; 362/298; 362/347

(58) Field of Search ..... 362/217, 223, 362/224, 260, 296, 297, 298, 304, 341, 342, 346, 347, 291, 279, 350, 206–208, 290

(56) References Cited

U.S. PATENT DOCUMENTS 4,539,628 A * 9/1985 Bartenbach ..... 362/217
4,717,992 A * 1/1988 Bartenbach et al. ..... 362/217
4,751,626 A * 6/1988 Plewman ..... 362/346

* cited by examiner

*Primary Examiner*—Sandra O'Shea
*Assistant Examiner*—Ismael Negron
(74) *Attorney, Agent, or Firm*—Williams, Morgan & Amerson, P.C.

(57) ABSTRACT

An overhead lighting appliance having a longitudinally extending and horizontally disposed lamp tube (4) housed within a reflector assembly of opposed downwardly diverging side reflectors (6) and cross blades (10) which divide the reflector assembly into cells and determine cut-off angles thus to reduce glare. Each cross blade (10) has an outer region (10*a*) to prevent ladder flash, which is of reduced or tapering thickness outwardly of a line C being a plane extending from the bottom of the reflector assembly to a tangent to an upper region of the lamp tube (4). The reduced width portion (10*a*) thus minimises obstruction of light output in the upper outer edge region of the cross blade.

15 Claims, 8 Drawing Sheets

LIGHTING APPLIANCE WITH GLARE REDUCING CROSS BLADES

THIS INVENTION concerns an overhead lighting appliance of the type known as a luminaire and consisting essentially of one or more horizontally disposed lamp tubes housed within a generally arcuately diverging longitudinal reflector assembly with crossblades at spaced disposition along the reflector assembly and extending at right angles to the longitudinal axis of the fluorescent lamp tube.

The purpose of the crossblades, in addition to assisting reflection of the light outwardly of the appliance, is to remove glare from the appliance by obscuring a direct line of sight to the lamp tube beyond a certain position beneath the appliance.

Whilst avoiding glare by the provision of such crossblades it is essential also to ensure, as far as possible, that the light output from the lamp tube is not excessively impaired or reduced by the presence of the crossblades between the tube and the light emission aperture or window of the appliance.

Typically, such crossblades are inwardly curved and tapered downwardly in cross-section, each terminating in a narrow line at its base which extends transversely across the appliance. At its upper end, each crossblade must have a thickness adequate to prevent direct reflection from the lamp tube thus to avoid glare and it is an object of the present invention to provide a crossblade design as a compromise between minimising glare and preventing, as far as possible, any appreciable loss of light output.

According to the present invention, an overhead lighting appliance having at least one longitudinally extending and horizontally disposed lamp tube housed in an upper region of a reflector assembly of generally arcuate downwardly diverging form, including longitudinally spaced cross blades extending transversely across the reflector housing; characterised in that each cross blade includes opposed outer and upper regions of reduced cross section extending outwardly from respective inclined planes which lie along the appliance and extend upwardly from adjacent outer lowermost corner regions respectively of the cross blade and form tangents to an upper semi-circle concentric with the longitudinal axis of the lamp tube.

Embodiments of the invention will now be described, by way of example only, with reference to the accompanying drawings, in which.

Figure 1:
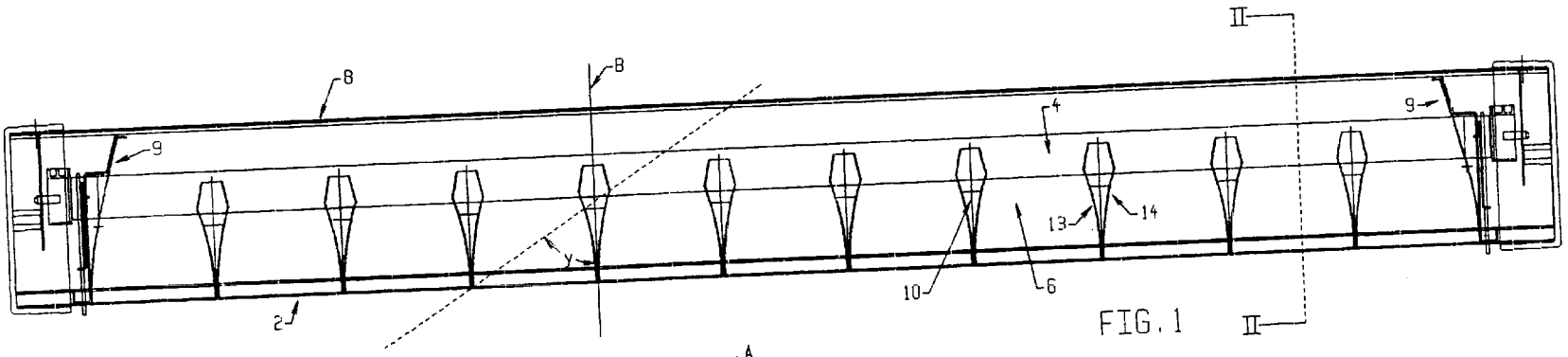
FIG. 1 is a partially cut-away side elevation of a lighting appliance incorporating the invention.

Referring now to the drawings, a luminaire comprises a housing 8 which contains a tubular fluorescent lamp 4 set longitudinally and provided with a pair of longitudinal side reflectors 6 to distribute light from the lamp through a light emission aperture or window 2.

The side reflectors 6 of arcuate downwardly diverging form are positioned opposite each other and parallel to a central plane A (FIG. 2) through the lamp 4, with two end plates 9 and a series of crossblades 10 which extend transversely across the luminaire between the reflectors 6.

Figure 2:
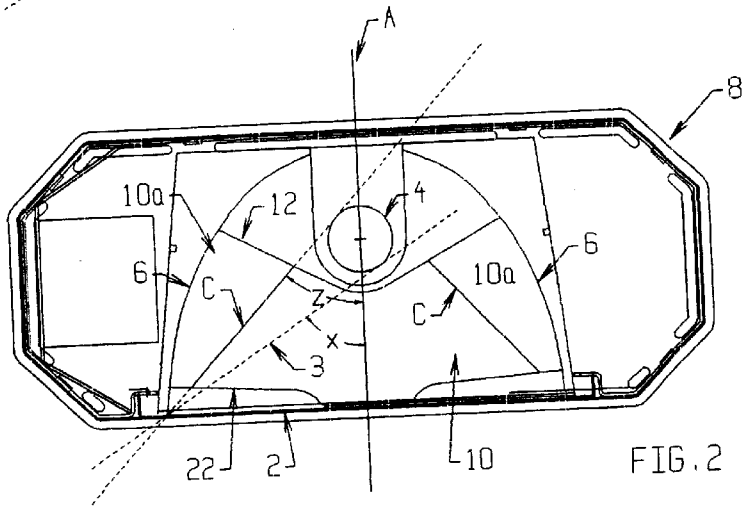
FIG. 2 is an enlarged cross-section taken on line II—II of FIG. 1.

The reflectors 6 are of specular or semi-specular material, concave in section as can be seen in FIG. 2 and are designed to direct light from the lamp 4 through the light emission aperture 2 at suitable angles. The side reflectors also prevent a direct view of the lamp above a plane lying at an angle x to plane A, known as the C90 plane in lighting technology terms.

The crossblades 10 are of specular or semi-specular material, three-dimensional in shape and spaced along plane A to prevent a direct view of the lamp from a position above a plane lying at an angle y (FIG. 1) to a plane B known as the C0 plane in lighting technology terms. Angles x and y are known as cut-off angles. The lower edge of each crossblade 10 lies on the plane of the light emission aperture 2. The lower edges of the side reflectors 6 may or may not lie on this plane but will be parallel to it.

Materials used for reflectors have a reflectance of up to approximately 95%, the remainder being absorption losses which cause the material to have some resultant luminance so that the reflector has some luminosity when viewed at angles greater than x and y. Using semi-specular reflecting materials increases the luminosity and this provides better visual comfort for the occupants of the space illuminated.

The combined profiles of the side reflectors 6, the end plates 9, and the crossblades 10 are such as to reflect light into the space to provide the required light distribution. The part of the light emission aperture 2 between the reflectors 6 and each pair of adjacent crossblades 10 is, in lighting technology terms, called a cell. These cells are typically rectangular. The efficiency of the reflector system is dependent upon the reflectance of the reflector material, the profiles of the reflecting surfaces, and the number of crossblades in the luminaire. Efficiency is impaired to some extent as a result of the obstruction caused by the crossblades themselves which nevertheless are necessary for the purpose of preventing visibility of the lamp above the cut-off angles.

The invention seeks to achieve an improvement in illumination efficiency according to the design of the crossblade to minimise obstruction thereby.

Each crossblade 10 can be made from the same material as the side reflectors 6 and the end plates 9, or from other materials. It has a cross section typically as shown in FIG. 1. The profile tapers downwardly and is preferably curved and concave but alternatively may be straight. The profile is determined according to the requirement to direct light from the lamp below the cut-off angle y as shown in FIG. 1.

In construction, the crossblade has two limbs 13 and 14 one on each side of each vertical plane B, and so there is a gap between the two limbs at the upper edge, which is usually open but may be closed to form a common upper edge. The upper edge or edges of each limb may be straight and horizontal or may curve about the lamp 4 and be inclined upwardly as shown at 12 in FIG. 2.

Where the upper edge profile extends upwardly, this is to avoid a bright array of reflections in the side reflectors 6 known as ladder flash. These reflections are caused by reflection of the self-lit interior of the crossblades reflecting at angles close to the cut-off angle x and occur just above each crossblade. Ladder flash is undesirable from a visual point of view.

However, such a profile results in an excessive obstruction to light output. The space inside the crossblade or between the two profiled limbs, if open, accepts light which is thus wasted. The deeper (taller) the outer parts of the crossblade, the greater the space between the two diverging limbs and so the greater is the waste of light. Where the upper edge of the crossblade is inclined upwardly as in FIG. 2 then the space between the two limbs becomes excessive towards the side reflectors 6. Thus the solution to eliminate ladder flash has the disadvantage of increasing the obstruction which the crossblade imposes on the light leaving the lamp through the light emission aperture.

The crossblade has a larger light reflecting surface than is necessary for the strict purpose of screening a direct view of the lamp. As shown in FIG. 2, a line 3 extends from the bottom edge region of each side reflector 6 and is tangential to the underside of the lamp 4. This line defines the angle x, and is equivalent to the cut-off line defining the angle y in FIG. 1.

FIG. 2 also shows another line C extending from the bottom edge of each side reflector 6 and tangential to the upper surface region of the lamp 4 and defines the angle z. These lines (forming planes extending longitudinally along the appliance one on each side of plane A) may be referred to as the screening lines or planes.

The central area between the screening lines C through plane A is the working area of the crossblade in so far as direct lamp screening is concerned. The profiled sections 10*a* of the crossblades 10 outside of the screening lines C have no affect on direct lamp shielding but are necessary to avoid ladder flash, that is to prevent reflections of the lamp in the side reflectors when looking into the reflector from diagonal directions below angles x and y. The crossblades 10 must enclose the space between the side reflectors 6 to form the closed cells.

Figure 3:
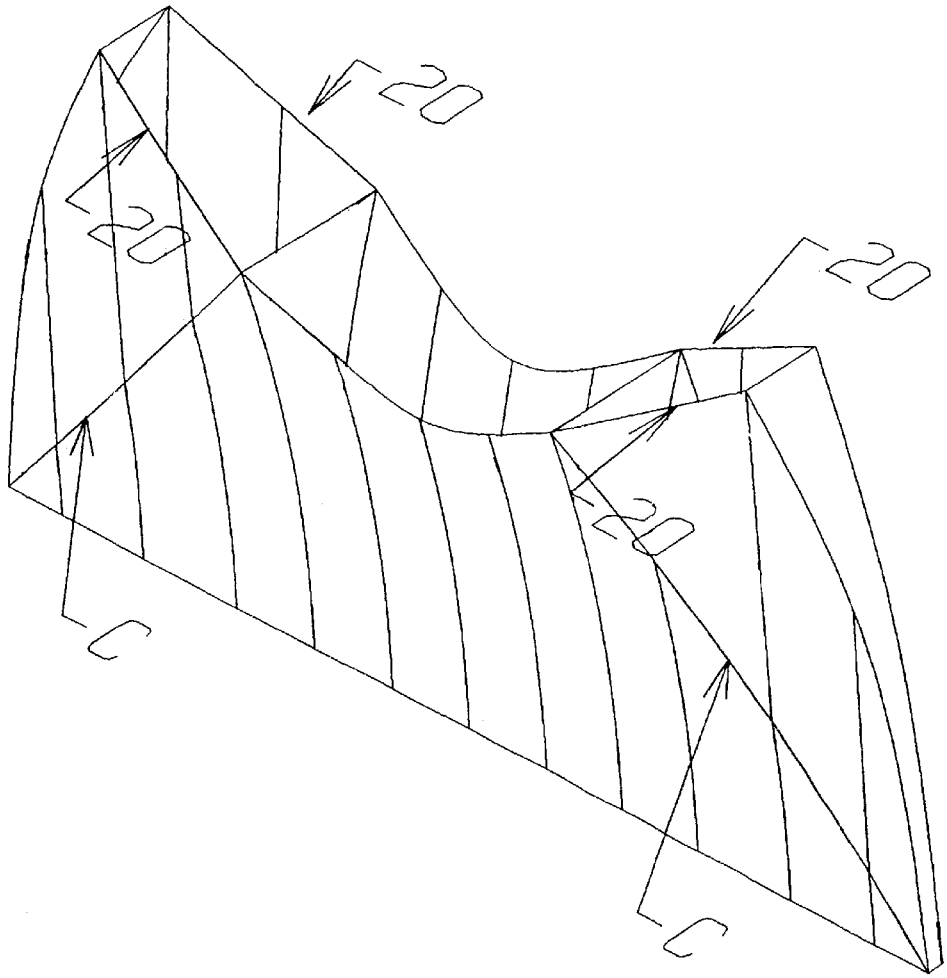
FIG. 3 is an enlarged perspective view of a crossblade being part of the appliance.

Referring now to FIG. 3 it will be seen that the upper edge of the profiled section outside of the screening lines C are reduced in thickness along lines 20 and thus reduce the obstruction caused by the upper edge of the crossblade to light being emitted through the light emission aperture 2.

Figure 4:
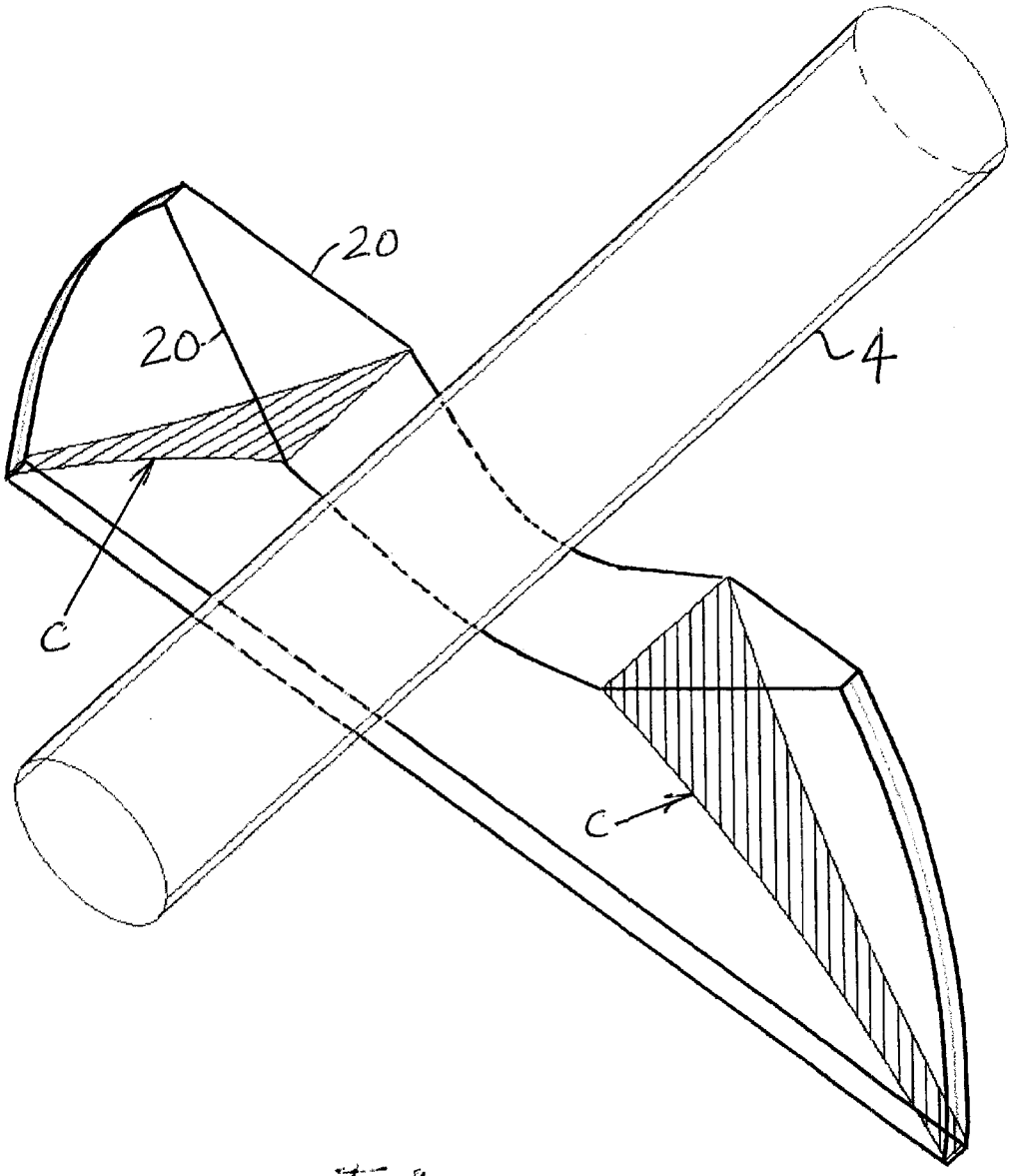
FIG. 4 is a perspective view of a modified crossblade, and shows the position of the lamp tube in relation thereto.

FIG. 4 shows how the upper region of the crossblade including its upper edge is tapered outwardly from line C, with the result that maximum light obstruction occurs only at the upper end of each line C. Also, in this embodiment, the outer edge of the crossblade is of uniform width.

Figure 5:
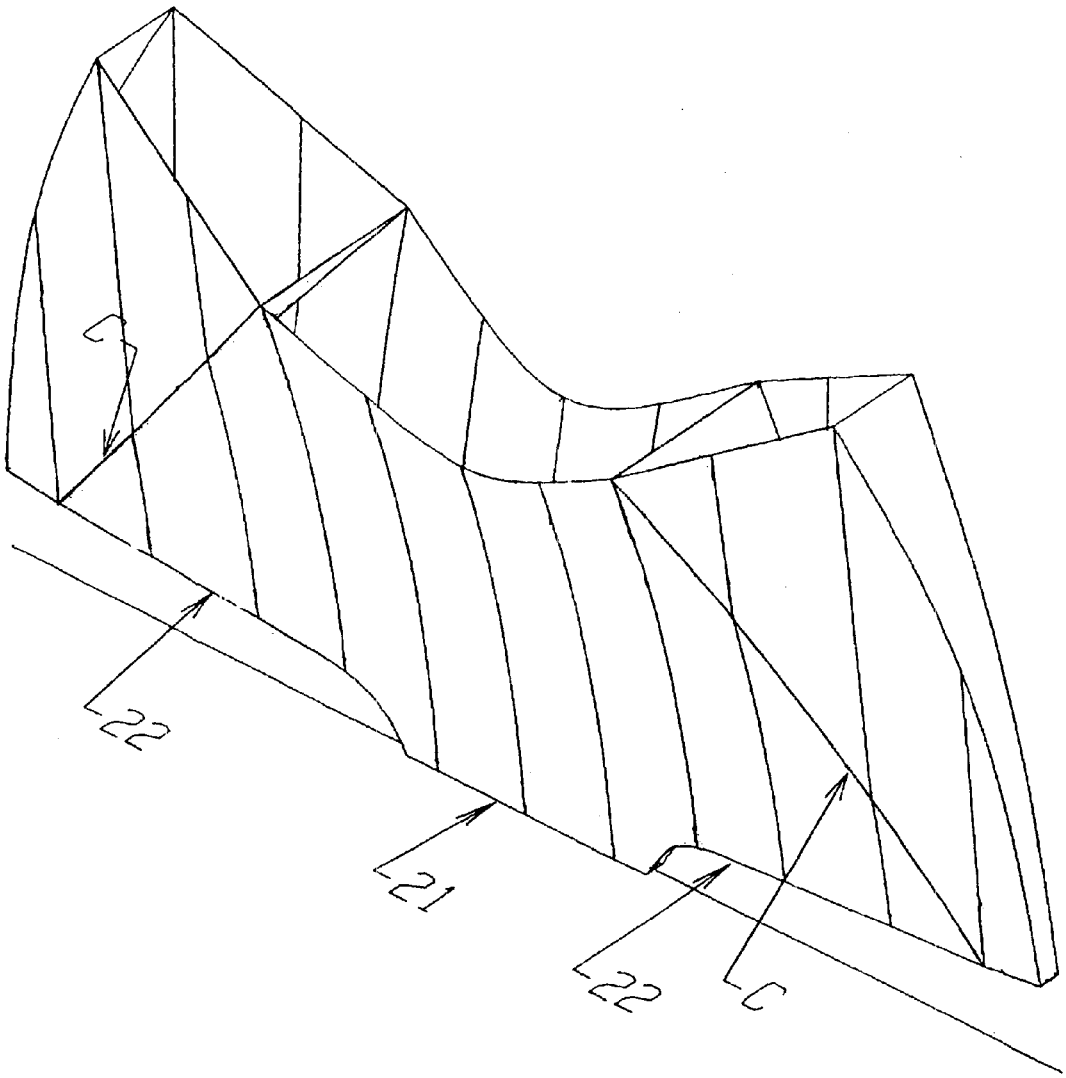
FIG. 5 is a perspective view of a further modified crossblade.

Referring now to FIG. 5, a similar crossblade profile is shown save for the lower edge having a central portion 21 lying on the plane of the light emission aperture and side sections 22 which curve upwardly and outwardly towards the outer transverse edges of the blade.

Figure 6:
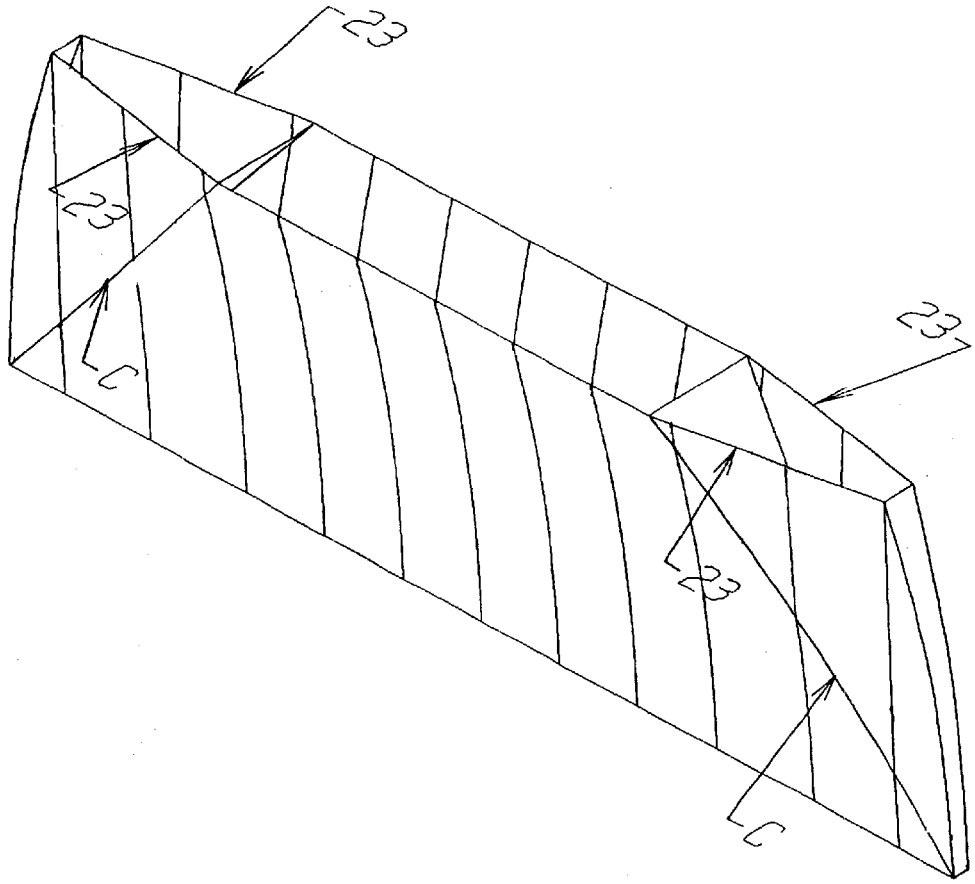
FIG. 6 is a perspective view of a still further modified crossblade.

Referring now to FIG. 6 in another embodiment, the lower edge of the crossblade is straight and horizontal and lies on the plane of the light emission aperture. Also, the upper edge of the blade is horizontal, but is tapered in its side regions beyond lines C and along tapered upper edge lines 23.

Figure 7:
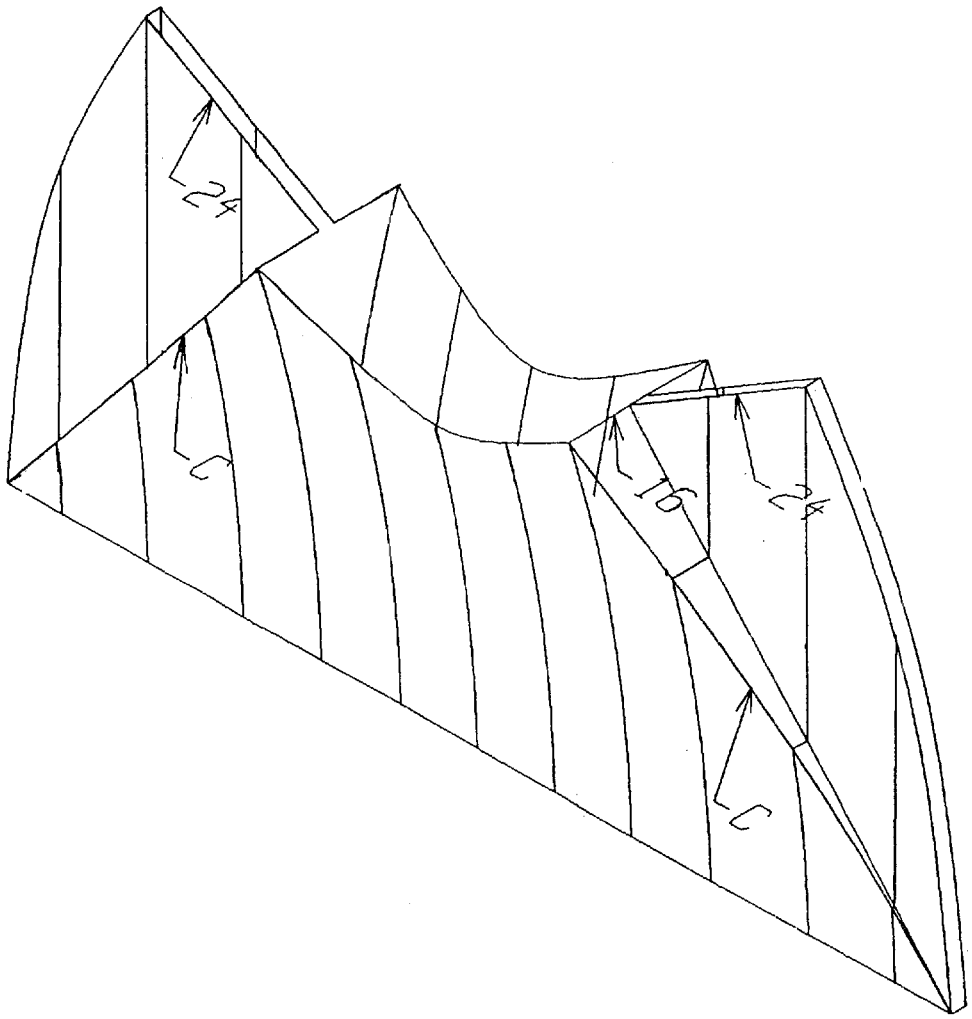
FIG. 7 is a perspective view of a still further modified crossblade.

Referring now to FIG. 7, in another embodiment, the side walls of the crossblade, beyond lines C are stepped down to a narrow parallel configuration as shown at 24. The overall upper edge of the crossblade in the embodiment of FIG. 7 is, however, upwardly curved as in FIG. 3.

Figure 8:
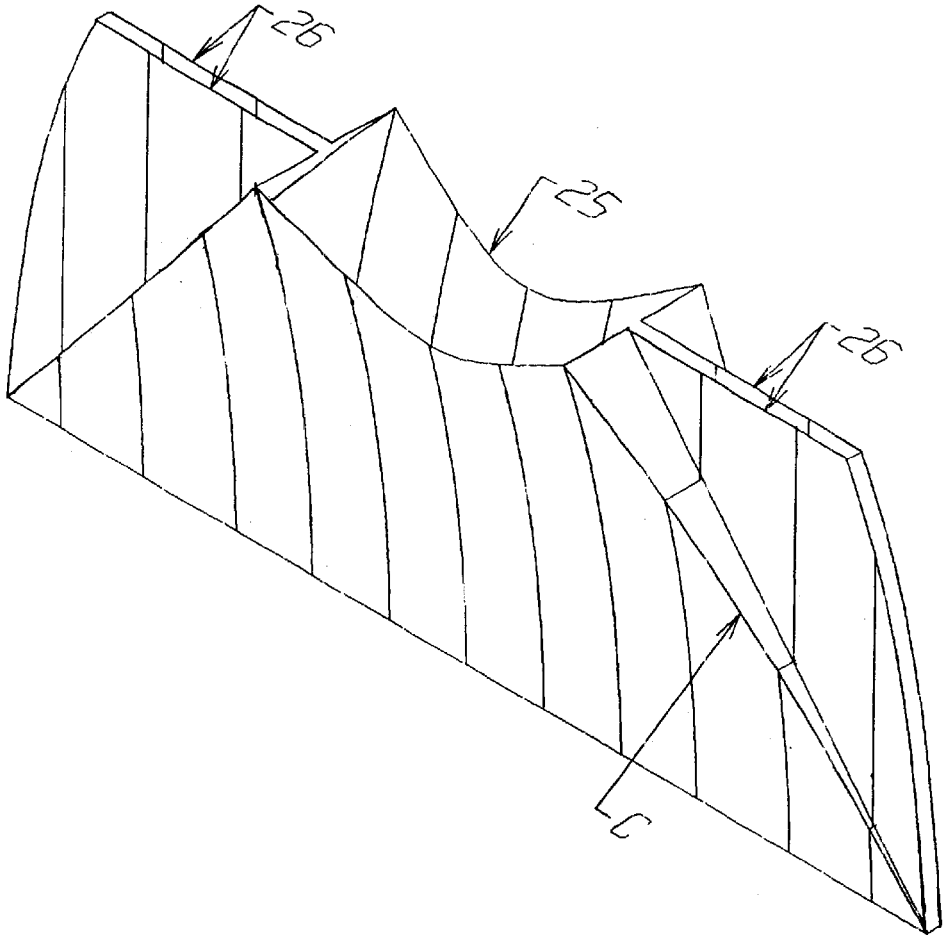
FIG. 8 is a perspective view of a still further modified crossblade.

In a further alternative embodiment as shown in FIG. 8, the central upper edge region 25 is curved about the lamp as in FIGS. 2 to 5 and FIG. 7, but outwardly beyond the lines C the upper edge is narrow and defined by a pair of horizontal parallel lines 26.

In all of the embodiments illustrated the side extensions of the crossblade beyond the lines C serve to prevent ladder flash but are reduced or tapered or reduced in thickness thus to minimise obstruction to light output in those regions.

While in FIGS. 7 and 8 the outer regions are stepped down to a minimum thickness, in the remaining figures the opposed walls of the crossblade are, in effect, bent inwardly about the lines C since the tapered lines 20, 23 in these embodiments are projected as converging walls outside lines C and extending down from the upper edge of the crossblade to its bottom corners.

The crossblades may be made from sheet metal, usually aluminium, having a specular or semi-specular surface, typically anodised or chemically coated. Alternatively they may be of sheet steel having polished or painted surfaces. Still further, the crossblades may alternatively be made from a plastics material by injection moulding and have reflective outer surfaces created by metal vapour deposition or by other metallising processes, or by the application of a reflective cover material.

Crossblades embodying the invention display a change of the reflecting surface at and beyond the screening lines C. These edge regions may be light absorbing rather than light reflecting and thus may provide some luminosity.

The edge regions may be of a different material from the reflecting surface of the region between the screening lines C.

Figure 9:
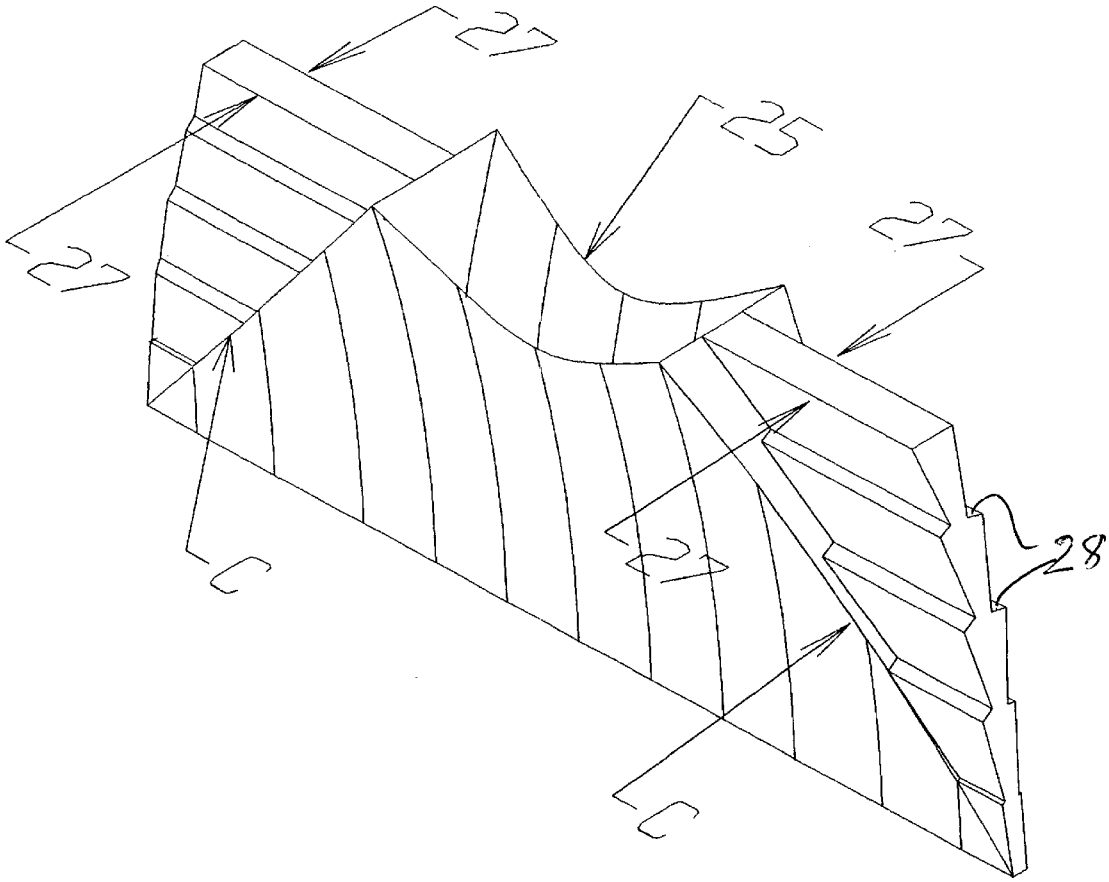
FIG. 9 is a perspective view of a still further modified crossblade.

The edge regions may not necessarily be a plane surface but may be textured in some way, perhaps with prisms, to change the direction of the light reflected from these outer edge regions. Such an embodiment is shown in FIG. 9 wherein stepped or prismatic surfaces 27 and 28 are formed in the edge regions beyond lines C.

It is not intended to limit the invention to the above examples, many variations being possible without departing from the scope of the invention which is intended to combine complete screening with optimal light obstruction by reducing the thickness of each crossblade beyond the lines C which extend from respective outer lower edge regions to positions wherein they form tangents to the upper side region of the lamp tube in the assembled luminaire. Where two or more lamp tubes are provided side-by-side between a pair of side reflectors, each screening line shall extend upwardly to a tangent to the upper side of the nearest lamp or tube.

What is claimed is:

1. An overhead lighting appliance comprising at least one longitudinally extending and horizontally disposed lamp housed in an upper region of a reflector assembly of generally arcuate downwardly diverging from, including longitudinally spaced cross blades extending transversely across the reflector housing; each cross blade including opposed outer and upper regions of reduced cross section extending outwardly from respective inclined planes which lie along the appliance and extend upwardly from adjacent outer lowermost corner regions respectively of the cross blade and form tangents to an upper semi-circle concentric with the longitudinal axis of the lamp tube.

2. A lighting appliance according to claim 1, wherein each of the inclined planes extends upwardly from a lower edge region of a respective one of a pair of opposed side reflectors forming the downwardly diverging reflector assembly.

3. A lighting appliance according to claim 1, wherein the cross blades include a plurality of lowermost outer corners and the inclined plane extends upwardly from the lowermost outer corners respectively of the cross blades.

4. A lighting appliance according to claim 1, wherein the inclined planes extend upwardly to form tangents to an upper region of the lamp tube.

5. A lighting appliance according to claim 1, wherein the reflector assembly defines a light mission aperture or window and comprises a pair of opposed downwardly diverging concave side reflectors, each side reflector including a lowermost edge and terminating on the plane of the light emission aperture or window of the appliance.

6. A lighting appliance according to claim 5, in which at least a part of the lowermost edge of each cross blade lies on the plane of the light emission aperture or window of the appliance.

7. A lighting appliance according to claim 1, wherein at least one cross blade includes an upper edge and the upper edge of each such cross blade is straight thus to lie horizontally beneath the lamp tube.

8. A lighting appliance according to any one of claims 1 to 6, wherein at least one cross blade includes an upper edge and the upper edge of each such cross blade is curved about the longitudinal axis of the lamp tube and is inclined upwardly on each side thereon.

9. A lighting appliance according to claim 1, wherein at least one cross blade includes an upper edge and the upper edge of each such cross blade is tapered outwardly from said inclined plane.

10. A lighting appliance according to claim 1, wherein at least one cross blade includes an outer edge and each outer edge of each such cross blade is of uniform width.

11. A lighting appliance according to claim 1, wherein the reflector assembly defines a light emission aperture or window, and wherein at least one cross blade includes a lower edge and the lower edge of each such cross blade has a central portion thereof lying on the plane of the light emission aperture or window of the appliance and is curved upwardly and outwardly from the central portion towards the outer transverse edges of the cross blade.

12. A lighting appliance according to claim 1, wherein at least one cross blade includes an a plurality of walls and the walls of each such the cross blade at and outwardly from said inclined plane are stepped down to a narrower configuration of uniform thickness.

13. A lighting appliance according to claim 1, wherein the surface of each cross blade outwardly of said inclined plane is of a material having different reflective properties from those of the remainder of the blade.

14. A lighting appliance according to claim 1, wherein the surface of each cross blade outwardly of said inclined plane is of textured or angular formation.

15. A lighting appliance according to claim 1, wherein the surface of each cross blade outwardly of said inclined plane is of a translucent material.

* * * * *